United States Patent [19]

Kuo

[11] Patent Number: 4,947,593

[45] Date of Patent: Aug. 14, 1990

[54] VENTILABLE CURTAIN WALL LINKED BY VENTILATING COUPLERS

[76] Inventor: Po-Pang Kuo, P.O. Box 10160, Taipei, Taiwan

[21] Appl. No.: 409,349

[22] Filed: Sep. 19, 1989

[51] Int. Cl.[5] ..... E04B 1/00; E04B 1/70

[52] U.S. Cl. ..... 52/105; 52/235; 52/302

[58] Field of Search ..... 52/105, 209, 235, 302

[56] References Cited

U.S. PATENT DOCUMENTS

| | | | |
|---|---|---|---|
| 3,221,453 | 12/1965 | Lietaert | 52/235 |
| 3,223,209 | 12/1965 | Skromeda | 52/235 |
| 3,415,024 | 10/1968 | Kotlarz | 52/235 |
| 4,055,923 | 11/1977 | Biebuyck | 52/302 |
| 4,672,784 | 6/1987 | Pohlar | 52/302 |

FOREIGN PATENT DOCUMENTS

| | | | |
|---|---|---|---|
| 2170238 | 7/1986 | United Kingdom | 52/235 |

*Primary Examiner*—James L. Ridgill, Jr.

[57] ABSTRACT

A ventilating curtain wall includes at least a vertical beam secured to a building framework and at least a horizontal beam, both beams being linked together by a ventilating coupler having a hollow bolt poking through the coupler, and each vertical beam being inserted with a ventilating pipe therein, so that a ventilating system will be formed in situ in the curtain wall for ventilating environmental air inside a building interior through a perforated horizontal beam, the ventilating coupler, and the ventilating pipe.

4 Claims, 2 Drawing Sheets

VENTILABLE CURTAIN WALL LINKED BY VENTILATING COUPLERS

BACKGROUND OF THE INVENTION

A conventional curtain wall is generally constructed by at least a vertical beam 1 and a horizontal beam 3; both beams 1, 3 linked together by a L-shaped bracket L and bolts B as shown in FIG. 8, which however has the following drawbacks:

1. The vertical and horizontal beams are not made for ventilating air in the curtain wall system so that other methods for ventilating the curtain wall should be further provided to increase installation cost, operation and maintenance problems for a building constructed by such a conventional curtain wall.

2. The whole curtain wall system including the vertical beams 1, the horizontal beams 3 and the L-shaped brackets L is lacking of measuring scale or means so that it should be carefully constructed and calibrated for its vertical or horizontal status, increasing construction inconvenience and installation labour cost.

3. The L-shaped bracket L having its horizontal leaf L1 secured to the horizontal beam 3 by a bolt B and having its vertical leaf L2 secured to the vertical beam 1 by the other bolt B may allow its horizontal leaf L1 to bear a great bending moment as loaded by the horizontal beam 3. If the strength or quality of the bracket L is not so good for durably supporting the horizontal beam, a fatigue failure of the bracket L may influence the construction safety of the whole building.

The present inventor has found the drawbacks of the conventional curtain wall and invented the present ventilable curtain wall.

SUMMARY OF THE INVENTION

The object of the present invention is to provide a ventilable curtain wall constructed by a plurality of vertical beams and horizontal beams, in which each vertical beam is prefixed by at least a ventilating coupler for mounting each horizontal beam thereon, the horizontal beam being drilled with holes fluidically communicated with interior air in a building and the vertical beam being inserted with a ventilating pipe fluidically communicated with the ventilating coupler and communicated with the horizontal beam, so that a well ventilation system will be formed within the beams, the couplers and the ventilating pipe enhancing the overall ventilation efficiency in a building.

DETAILED DESCRIPTION

Figure 1:
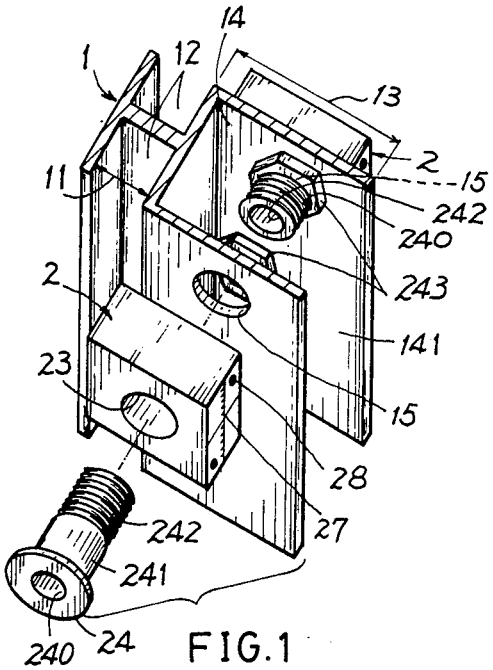
FIG. 1 is an illustration showing a vertical beam and a ventilating coupler of the present invention.
Figure 2:
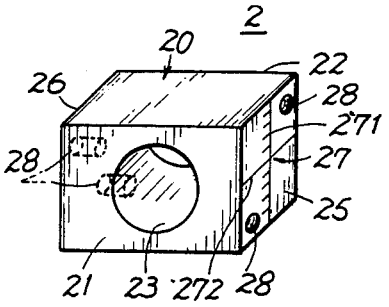
FIG. 2 shows the ventilating coupler of the present invention.

As shown in FIGS. 1–7, the present invention comprises: a plurality of vertical beam 1 and a plurality of horizontal beams 3, each vertical beam 1 being prefixed at least a ventilating coupler 2 for securing each horizontal beam 3 thereon and each vertical beam 1 being inserted with a ventilating pipe 4 therein.

Figure 4:
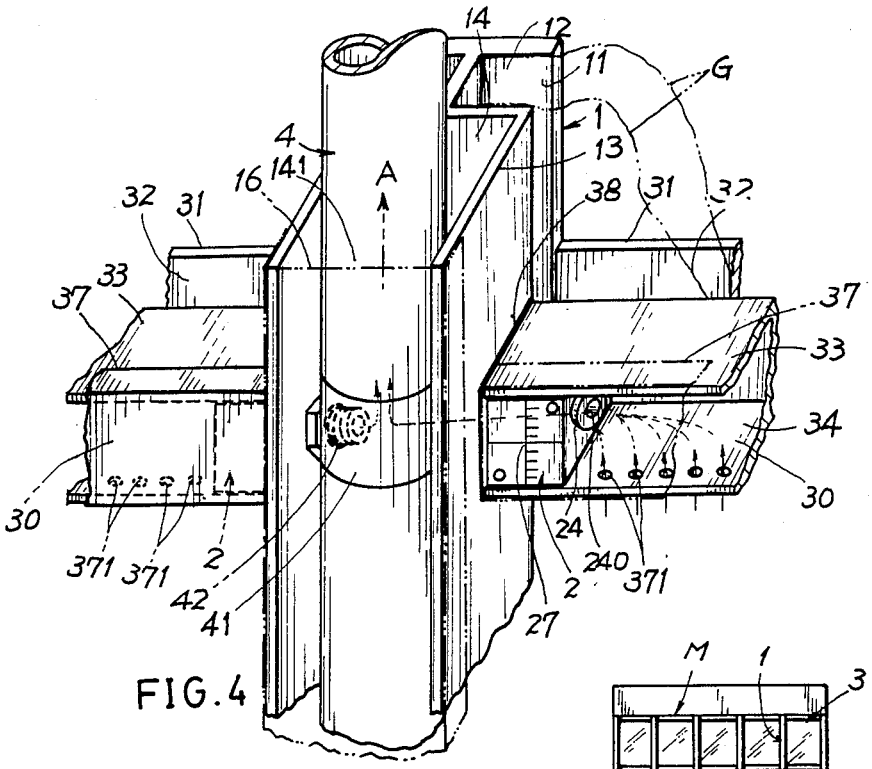
FIG. 4 is a perspective view showing a ventilation system made in accordance with the present invention.

The vertical beam 1 includes: an external portion 11 having at least a longitudinal vertical groove 12 for securing glass sheet G therein and having a generally H-shaped cross section, an internal portion 13 facing interior of a building having a longitudinal vertical U-shaped groove 14 for inserting the ventilating pipe 4 therein, at least a pair of bolt holes 15 formed in two side walls of the internal portion 13, and a vertical cover 16 shielding a vertical opening 141 formed on an outer port of the U-shaped groove 14 as shown in FIG. 4.

The ventilating coupler 2 includes a parallelepiped or cube block 20, a central bolt hole 23 transversely formed through a front surface 21 and a rear surface 22 of the parallelepiped block 20, a hollow bolt 24 poking through the bolt hole 23 and the bolt hole 15 of the vertical beam for securing the coupler 2 on the beam 1, two measuring scales 27 respectively formed on two opposite vertical side surfaces 25, 26 of the parallelepiped block 20, and a plurality of screw holes 28 formed in two side surfaces 25, 26 of the block 20. The block 20 is encased in a side portion of the horizontal beam 3.

The hollow bolt 24 includes a shank portion 241 poking through the bolt holes 23, 15, a male-threaded portion 242 formed on a rear end of the shank portion 241, a nut 243 having a female-threaded bore engaged with the male-threaded portion 242 for securing the block 20 on the vertical beam 1, and a central hole 240 formed through the bolt 24.

Each measuring scale 27 includes an ordinate scale 271 parallel to a longitudinal gravitational axis of the vertical beam 1, and an abscissa scale 272 horizontally perpendicular to the ordinate scale 271. Other kinds of measuring scales or marks may also be made on all outer surfaces of the parallelepiped block 20.

The horizontal beam 3 includes: an external portion 31 having at least a longitudinal horizontal groove 32 having a generally H shaped cross section for securing a glass sheet G in the groove 32, an internal portion 33 having a longitudinal horizontal U-shaped groove 34 engageable with the parallelepiped block 20 of the ventilating coupler 2, a plurality of screw holes 35 formed in the beam 3, a plurality of screws 36 poking through the screw holes 35, 28 for fixing the horizontal beam 3 on the coupler 2 already secured to the vertical beam 1, a horizontal cover 37 shielding a horizontal opening of an outer port of the groove 34 as shown in FIG. 4 to confine an air ventilating channel 30 in the horizontal beam 3, and a sealant 38 provided for sealing any aperture at a connection portion between the vertical beam 1 and the horizontal beam 3. The horizontal cover 37 is drilled with a plurality of ventilating holes 371 for directing environmental air in a building into the channel 30 in the beam 3.

The ventilating pipe 4 is inserted in the vertical groove 14 in the beam 1 and may include several joints 41 each joint 41 having connectors or adapters 42 connected with a rear portion of the hollow bolt 24.

Figure 3:
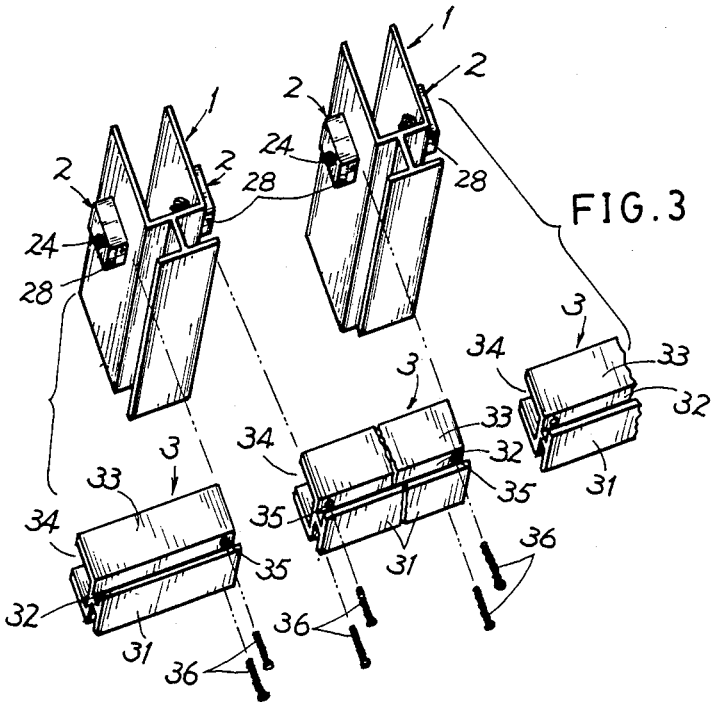
FIG. 3 shows an exploded view of the present invention.
Figure 5:
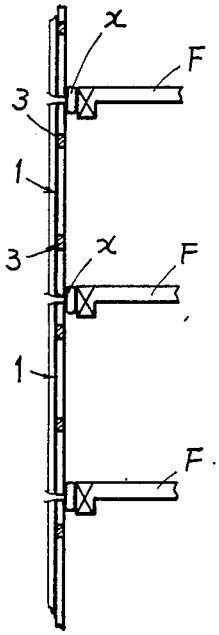
FIG. 5 is a side-view illustration showing a vertical erection of the present invention.

The couplers 2 may be precisely fixed on the vertical beam 1 in a factory with every two neighboring couplers being separated at a predetermined distance S which distance S is also a distance between two horizontal beams 3. The pipe 4 may also be incorporated in the beam 1 in factory production. When the vertical beams 1 are erected in the building site by securing the beams on a framework F by fixing members X as shown in FIG. 5, each beam may be calibrated for its vertical orientation by checking the ordinate scale 271 to be parallel to or aligned with a gravitational line of a measuring instrument. Since the abscissa scale 272 is perpendicular to the ordinate scale 271, the horizontal beam 3 can be horizontally secured on two couplers 2 formed on two vertical beams 1 as shown in FIG. 3. The two abscissa scales 272 respectively formed on two couplers 2 fixed on two separate vertical beams 1 may also be used for calibrating a horizontal plane kept between the two abscissa scales for ensuring a real horizontal laying of the horizontal beam 3 on such two couplers 2. For more stable fixation of the coupler 2 on a vertical beam 1, two bolts 24 may be used to firmly securing the block 20 on the beam 1.

Figure 7:
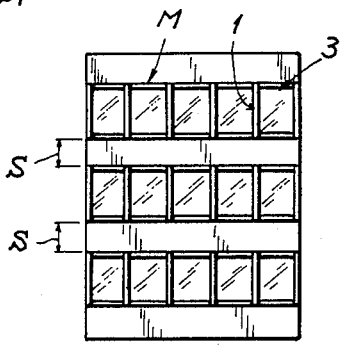
FIG. 7 shows a front elevation of the present invention constructed by the vertical beams as shown in FIG. 6.
Figure 6:
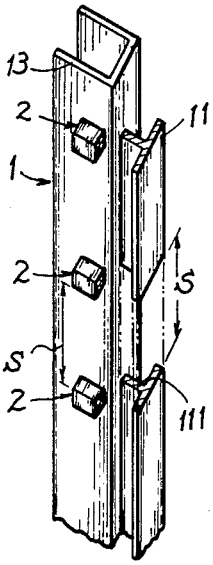
FIG. 6 shows a partially cut vertical beam of the present invention.
Figure 8:
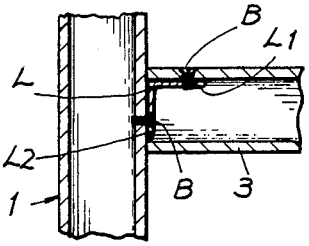
FIG.8 PRIOR ART
FIG. 8 shows a prior art of a conventional curtain wall having the beams linked by a L-shaped bracket.

As shown in FIGS. 6, 7, the external portion 11 of the vertical beam 1 may be cut or removed between every two couplers 2 for embedding a marble stone M in each recess area 111 as shown in FIG. 6. Since the distance S between two couplers 2 is predetermined, the height of marble stone M is therefore equal to the distance S between two couplers 2 for a quicker construction job.

Once the present invention is installed, an environmental air inside a building may rise upwardly to enter holes 371 and flow through channel 30 in the horizontal beam 3, the hollow bolt 24 of the coupler 2 and the pipe 4 which may be connected to a building air conditioning or circulation system for better ventilation of room air. Since the ventilating system of the present invention comprised of beams 1, 3, couplers 2 and pipes 4 are formed in situ in the curtain wall system, an air ventilating system inside a building with cheaper cost can be accomplished. Such a ventilating system can be cooperated or connected with a central air conditioning system inside a building.

The curtain wall is subject to sunlight exposure and the air adjacent to the glass sheet of the curtain wall will soon become heated, such a hot air may rise and be drafted by the ventilating system of the present invention to decrease the load of a central air conditioning system for saving energy and also comforting the people inside the building.

In winter season, a warm air stream may be led into this ventilating system to prevent fogging on the glass sheet of the curtain wall.

Accordingly, this invention is superior to a conventional curtain wall with the following advantages:

1. The ventilating system is formed in situ in the curtain wall for efficiently ventilating air inside a building.

2. The measuring scale 27 formed on each block 20 may help calibrate the vertical status of the vertical beam 1 and the horizontal situation of the horizontal beam 3 to facilitate construction job and also reduce labor cost.

3. The coupler 2 is formed as a generally solid block (except its bolt hole 23) for uniformly distributing or reducing the stress applied thereon by the weight of the horizontal beam 3 for stably securing the horizontal beam 3 on the vertical beams 1.

I claim:

1. A ventilable curtain wall comprising:

a plurality of vertical beams secured to a building framework each vertical beam having at least a longitudinal vertical groove formed in a first exteral portion of said vertical beam for inserting a glass sheet in said vertical groove and having a vertical U-shaped groove formed in a first internal portion facing interior of a building, at least a pair of bolt holes formed in two vertical side walls of said vertical beam, and a vertical cover shielding said U-shaped groove;

a plurality of horizontal beams each horizontal beam having at least a longitudinal horizontal groove formed in a second external portion of said horizontal beam for securing the glass sheet therein and having a horizontal U-shaped groove formed in second internal portion facing the interior of the building, and a horizontal cover drilled with a plurality of ventilating holes therein shielding the horizontal U-shaped groove confining a horizontal ventilating channel in said horizontal beam;

a ventilating coupler prefixed on each said vertical beam by a hollow bolt and engageable with said horizontal U-shaped groove for securing said horizontal beam on said vertical beam; and a ventilating pipe inserted in said vertical U-shaped groove in each said vertical beam having joint means fluidically communicated with said hollow bolt of said coupler and said ventilating channel in said horizontal beam, so that a ventilating system is formed in said curtain wall through said ventilating holes, said ventilating channel in said horizontal beam, said hollow bolt of said coupler and said ventilating pipe in said vertical beam.

2. A curtain wall according to claim 1, wherein said ventilating coupler includes: a parallelepiped block encased in a side portion of said horizontal beam having a central bolt hole formed through a front surface and a rear surface of said block aligned with the bolt hole formed in said vertical beam for poking said hollow bolt therein, at least a measuring scale formed on a side surface of said block for calibrating a vertical or horizontal status of said beams, and a plurality of screw holes formed in said side surface for fixing said horizontal beam on said coupler by screws.

3. A curtain wall according to claim 2, wherein said hollow bolt includes a shank portion poking through said bolt holes, a male-threaded portion formed on a rear end of said shank portion engageable with a female-threaded bore of a nut securing the bolt on said vertical beam, and a central hole formed through said bolt for fluidically communicating a building interior with the horizontal beam, the coupler and the ventilating pipe.

4. A curtain wall according to claim 2, wherein said measuring scale formed on said coupler includes an ordinate scale parallel to a longitudinal gravitational axis of said vertical beam, and an abscissa scale perpendicular to said ordinate scale.

* * * * *